US007600869B2

(12) United States Patent
Usui

(10) Patent No.: US 7,600,869 B2
(45) Date of Patent: Oct. 13, 2009

(54) STORAGE HOUSING FOR STORING RECORDING HEAD

(75) Inventor: Takamasa Usui, Ogaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 458 days.

(21) Appl. No.: 11/533,621

(22) Filed: Sep. 20, 2006

(65) Prior Publication Data

US 2007/0064080 A1 Mar. 22, 2007

(30) Foreign Application Priority Data

Sep. 22, 2005 (JP) ..... 2005-276149

(51) Int. Cl.
*B41J 29/43* (2006.01)
*B41J 2/015* (2006.01)
*B41J 2/175* (2006.01)

(52) U.S. Cl. ..... 347/108; 347/20; 347/86

(58) Field of Classification Search ..... 347/86, 347/108

See application file for complete search history.

(56) References Cited

U.S. PATENT DOCUMENTS 5,552,816 A * 9/1996 Oda et al. ..... 347/86
6,247,598 B1 * 6/2001 Hosaka et al. ..... 206/723

FOREIGN PATENT DOCUMENTS

JP H10272780 10/1998

* cited by examiner

*Primary Examiner*—Stephen D Meier
*Assistant Examiner*—Kar Yip
(74) *Attorney, Agent, or Firm*—Baker Botts L.L.P.

(57) ABSTRACT

A storage housing for storing a recording head having inside and outside surfaces and operable to perform a recording operation by an ink which is supplied to the recording head through an ink inlet opening in the inside surface and which is ejected through nozzles opening in the outside surface. The storage housing including: first and second bodies which include first and second sealing portions, respectively, and which are opposed to each other with the inside and outside surfaces of the recording head being interposed between the first and second bodies, such that the ink inlet is sealed by the first sealing portion and such that the nozzles are sealed by the second sealing portion. One of the first and second bodies includes an arm movable to attach and detach the one of the first and second bodies to and from the recording head. The other of the first and second bodies includes a protecting cover positioned outside at least a distal end portion of the arm so as to cover at least the distal end portion of the arm.

25 Claims, 10 Drawing Sheets

STORAGE HOUSING FOR STORING RECORDING HEAD

This application is based on Japanese Patent Application No. 2005-276149 filed on Sep. 22, 2005, the content of which is incorporated hereinto by reference.

BACKGROUND OF THE INVENTION

1. Field of the Invention

The present invention relates to a storage housing for storing a recording head that is dismounted from a main body of a recording apparatus such as an inkjet recording apparatus that is operable to perform a recording operation by ejecting an ink toward a recording medium.

2. Discussion of Related Art

A recording head of a recording apparatus such as an inkjet recording apparatus is individually stored in a storage housing, when the recording head is not used for a recording operation, or before the recording head is mounted on a main body of the recording apparatus after it has been manufactured. In this stage in which the recording head is stored in the storage housing while being filled with an ink or preservation liquid, a protector body is provided to seal nozzles and ink inlets (through which the ink is to be supplied into the recording head), as disclosed in JP-H10-272780A, for preventing the ink or preservation liquid from being dried or leaked.

The protector body includes (i) sealing portions (caps) made of elastic material such as rubber and arranged to cover the nozzles and ink inlets, and (i) engaging portions arranged to be held in engagement with the recording head or the; storage housing storing the recording head, so as to attach the protector body to the recording head or the storage housing. Since the engaging portions are provided to be exposed for facilitating an operation for attaching and detaching the protector body to and from the recording head or the storage housing, the engagement of each engaging portion could be easily released in the event of application of an external force to the engaging portion, for example, during transit or storage. In such a case, as a result of the release of the engagement of the engaging portion, the protector body is detached from the recording head or the storage housing, thereby causing a risk of drying or leakage of the ink or preservation liquid.

SUMMARY OF THE INVENTION

The present invention was made in view of the background prior art discussed above. It is therefore an object of the invention to provide a storage housing for storing a recording head while reliably sealing nozzles and an ink inlet of the recording head.

This object may be achieved by the present invention providing a storage housing for storing a recording head of a recording apparatus that is dismounted from a main body of the recording apparatus, the recording head having an inside surface and an outside surface and operable to perform a recording operation by an ink which is to be supplied to the recording head through an ink inlet opening in the inside surface and which is to be ejected toward a recording medium through nozzles opening in the outside surface, the storage housing including: a first body and a second body which include a first sealing portion and a second sealing portion, respectively, and which are opposed to each other in an opposed direction, with the inside and outside surfaces of the recording head being interposed between the first and second bodies in the opposed direction, such that the ink inlet opening in the inside surface is sealed by the first sealing portion and such that the nozzles opening in the outside surface are sealed by the second sealing portion, wherein the first and second bodies further include respective first and second extending portions which extend in the opposed direction and which are positioned outside the interposed recording head as seen in the opposed direction, wherein one of the first and second extending portions provides an arm that is movable to attach and detach one of the first and second bodies that includes the one of the first and second extending portions, to and from the recording head, and wherein the other of the first and second extending portions provides a protecting cover that is positioned outside at least a distal end portion of the arm as seen in the opposed direction so as to protect or cover at least the distal end portion of the arm.

In the recording head storage housing according to the invention, the arm and the protecting cover are provided by the one and other of the first and second extending portions of the respective first and second bodies, and at least the distal end portion of the arm is covered by the protecting cover that is positioned outside the at least distal end portion of the arm, whereby at least the distal end portion of the arm is protected by the protecting cover from an external load, thereby eliminating a risk of removal of the above-described one of the first and second bodies from the recording head. Further, in the present recording head storage housing, the recording head can be stored with the ink inlet and the nozzles being sealed, simply by attaching the first and second bodies to the recording head. That is, the present storage housing is capable of storing the recording head while reliably sealing the ink inlet and the nozzles of the recording head.

BRIEF DESCRIPTION OF THE DRAWINGS

The above and other objects, features, advantages and technical and industrial significance of the present invention will be better understood by reading the following detailed description of presently preferred embodiments of the invention, when considered in connection with the accompanying drawings, in which.

DETAILED DESCRIPTION OF THE PREFERRED EMBODIMENT

Figure 1:
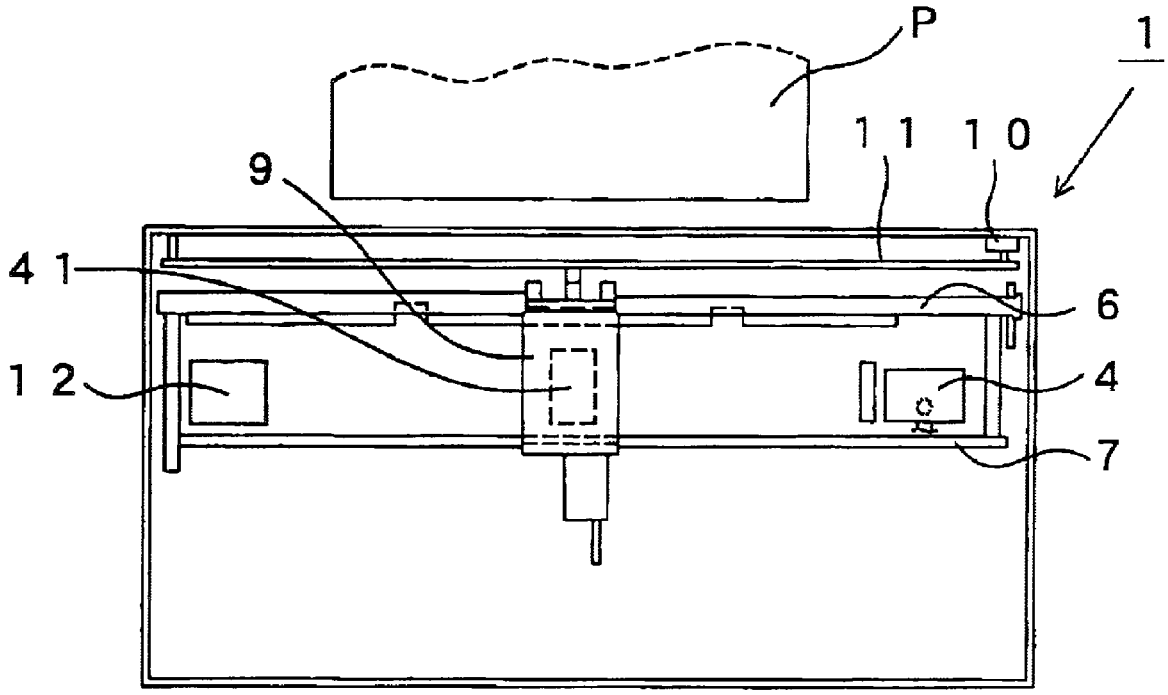
FIG. 1 is a plan view schematically showing an inkjet recording apparatus equipped with a recording head that can be stored by a recording head storage housing according to the invention.

Referring first to FIG. 1, there will be described a major construction of a inkjet recording apparatus 1 equipped with a recording head 41 that can be stored by a recording head storage housing constructed according to the present invention.

The inkjet recording apparatus 1 includes: two guide rods 6, 7 that are disposed inside the apparatus 1; and a carriage 9 is movably attached to the guide rods 6, 7. The carriage 9 is arranged to carry the recording head 41 that is operable to perform a recording operation by ejecting an ink toward a recording medium P. The recording head 41 has an ink inlet 41*c* (see FIG. 4) through which the ink is to be supplied from an ink cartridge (not shown) that is mounted on the recording head 41. The carriage 9 is attached to an endless belt 11 that is to be circulated by a motor 10, so that the carriage 9 is movable along the guide rods 6, 7 by driving the motor 10. A known linear scale (not shown) is provided to extend along the guide rod 7. The linear scale is provided by a strip-like member, and has marks for detecting a position of the movable carriage 9.

The apparatus 1 further includes a flushing portion 12 and a maintenance portion 4 that are located in one and the other of opposite ends in a direction of the movement of the carriage 9. In the flushing portion 12, a deteriorated ink containing bubbles is ejected out from the recording head 41. In the maintenance portion 4, the deteriorated ink is sucked from the recording head 41, and an outside surface (nozzle opening surface) of the recording head 41 is wiped. That is, the flushing portion 12 and the maintenance portion 14 are provided for the purpose of maintaining a condition required for exhibiting a satisfactory ink ejection performance.

Figure 2:
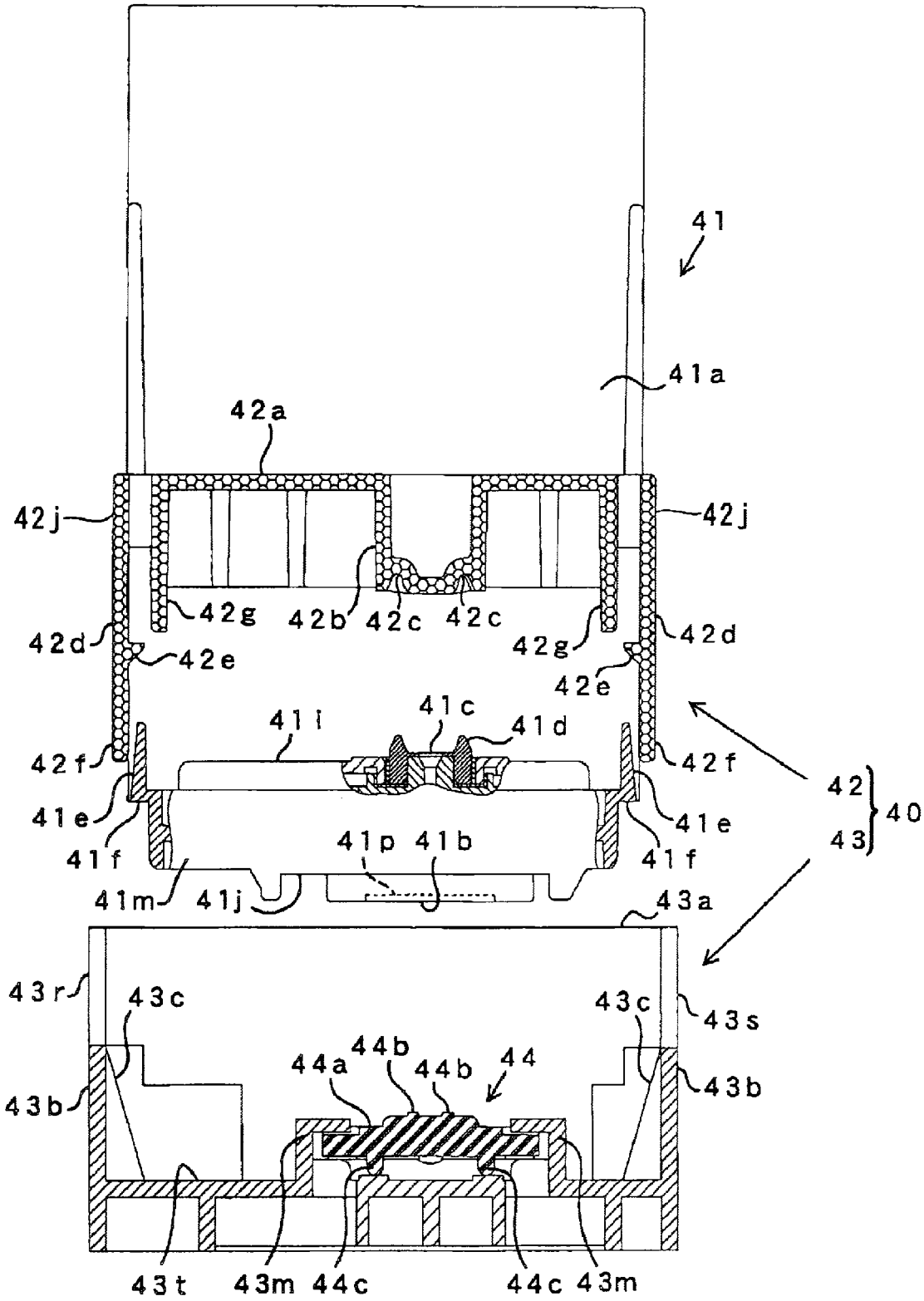
FIG. 2 is a front view showing, in cross section, a recording head storage housing according to a first embodiment of the invention and the recording head that is to be stored by the storage housing.
Figure 3:
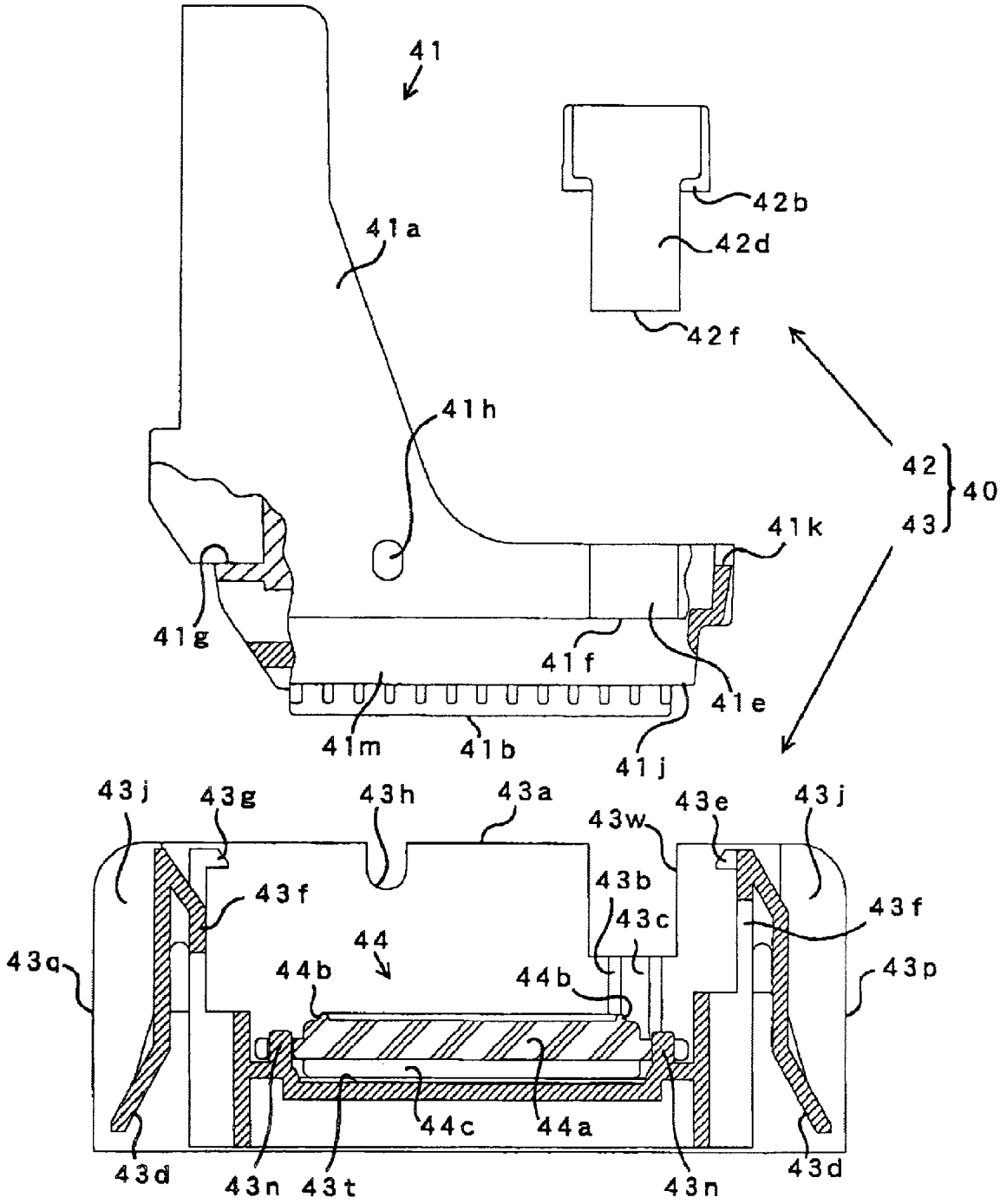
FIG. 3 is a left-side view showing, partially in cross section, the recording head storage housing according to the first embodiment of the invention and the recording head that is to be stored by the storage housing.
Figure 4:
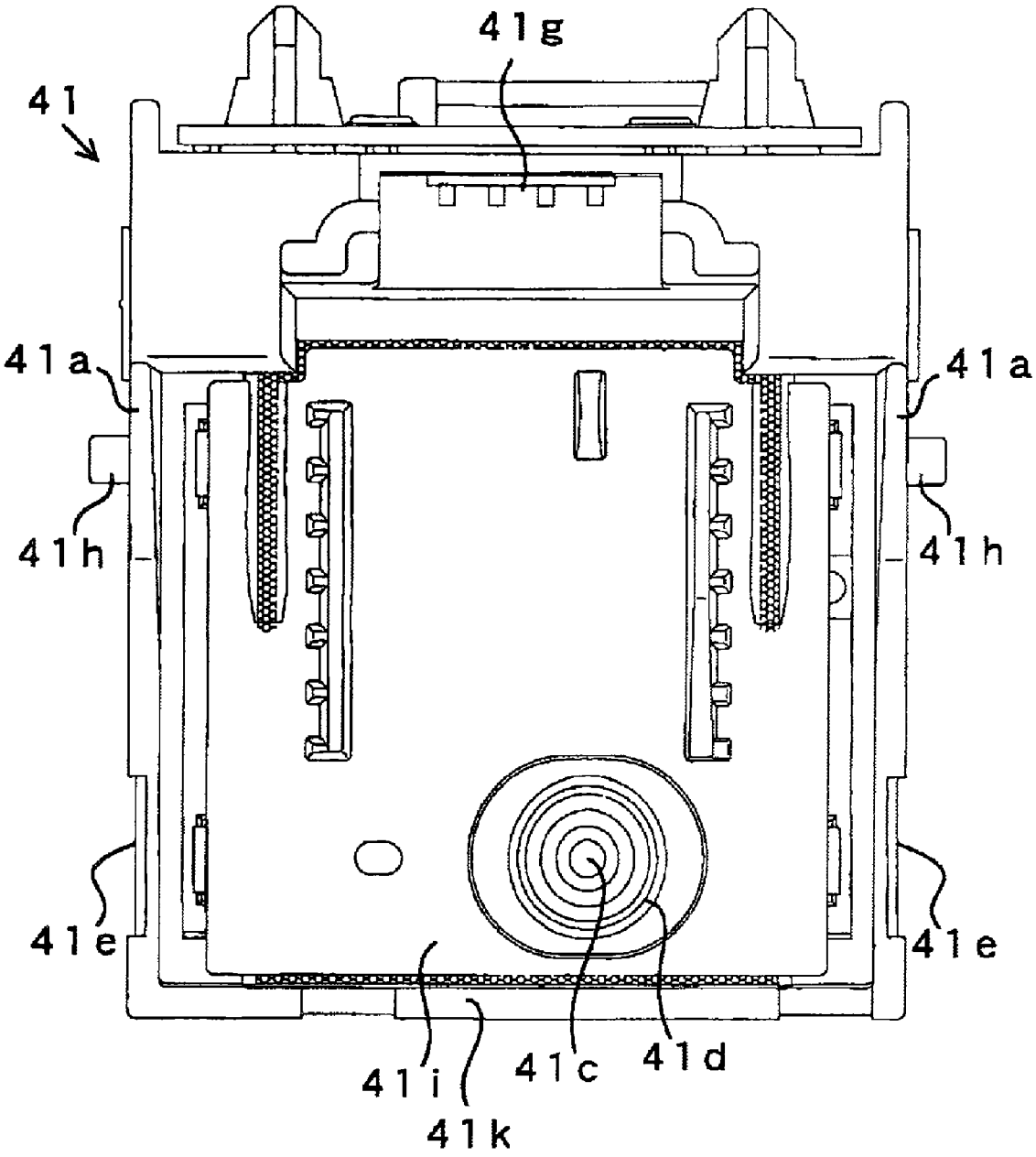
FIG. 4 is an upper plan view of the recording head.

Referring next to FIGS. 2-8, there will be described a recording head storage housing 40 constructed according to a first embodiment of the invention. FIG. 2 is an exploded view showing a first body 42 and a second body (storage casing) 43 of the storage housing 40 and the recording head 41 that is to be stored by the storage housing 40. As shown in FIGS. 2, 3 and 4, the recording head 41 has, in its rear portion, a box-like shaped mounting portion 41*a* which has an upper opening and on which an ink cartridge (not shown) for a black ink is to be removably mounted. Below the mounting portion 41*a*, there is provided a block-like shaped holder portion 41*m*. The holder portion 41*m* has an upper surface 41*i* in which an ink inlet 41*c* is formed to open upwardly. When the ink cartridge (not shown) is mounted on the mounting portion 41*a*, the ink inlet 41*c* is brought into communication with an ink outlet (not shown) of the ink cartridge, so that the ink can be introduced into the recording head 41 through the ink inlet 41*c*. The ink inlet 41*c* is surrounded by an annular-shaped connecting member 41*d* that is made of an elastic material such as a rubber. The holder portion 41*m* further has a lower surface 41*j* that is provided with an ejection mechanism portion 41*p* for performing the recording operation. The ejection mechanism portion 41*p* has a lower surface, i.e., a nozzle opening surface 41*b* in which nozzles open downwardly. It is noted that the upper surface 41*i* and the nozzle opening surface 41*b* serve as inside and outside surfaces of the recording head 41, respectively.

Protrusions 41*h*, 41*h* are provided to protrude outwardly from respective right and left side walls of the recording head 41 (see FIGS. 3 and 4), so as to be fitted in respective recesses 43*h*, 43*h* that are formed in upper end portions of respective right and left side walls 43*s*, 43*r* of the second body 43 (see FIG. 3), whereby the recording head 41 can be positioned in a predetermined position relative to the second body 43. Each of the right and left side walls of the recording head 41 has an outside surface including an inclined portion 41*e*. In the inclined portion 41*e*, the outside surface is inclined inwardly as it extends upwardly. When the first body 42 is intended to be attached to the recording head 41, engaging portions 42*e*, 42*e* of the first body 42 are brought into contact with the respective inclined portions 41*e*, 41*e*, and are guided outwardly by the inclined portions 41*e*, 41*e* as the first body 42 is moved downwardly relative to the recording head 41. The engaging portions 42*e*, 42*e* are eventually held in fixed engagement with respective engaged portions 41*f*, 41*f* each located on a lower side of the corresponding inclined portion 41*e* and inwardly recessed.

Figure 5:
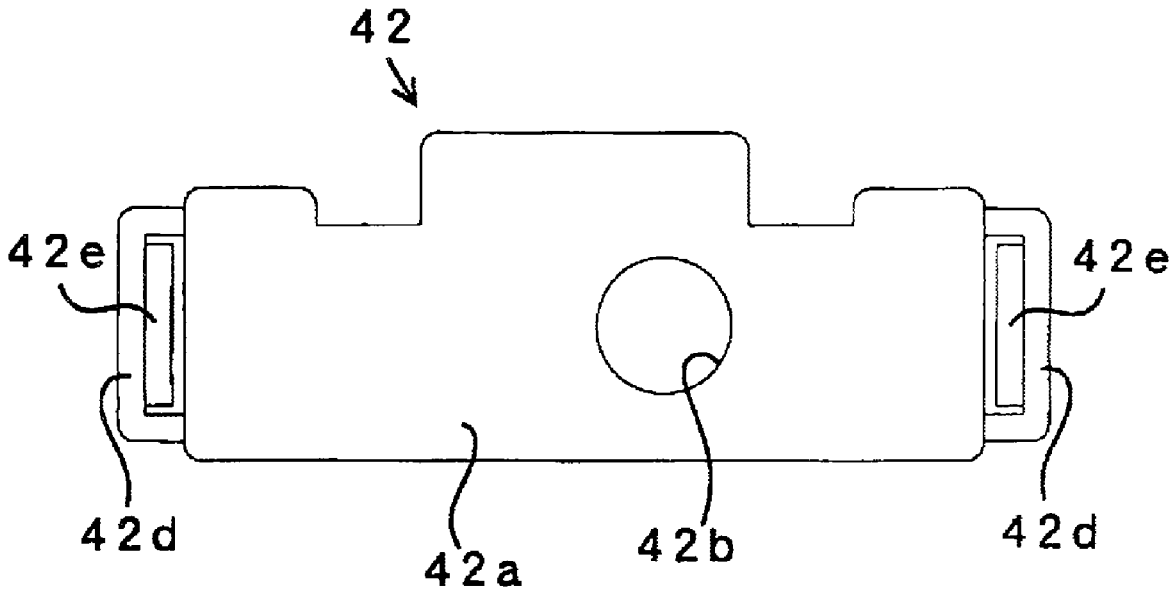
FIG. 5 is an upper plan view of a first body of the recording head storage housing according to the first embodiment of the invention.

The recording head storage housing 40 is constituted principally by the first body 42 and the second body (storage casing) 43 that includes a nozzle sealing member 44 as a second sealing portion. As shown in FIGS. 2, 3 and 5, the first body 42 includes: a main portion 42*a* extending generally in a horizontal; direction; a pair of first extending portions (first wall portions) in the form of plate-like shaped engagement establishing arms 42*d*, 42*d* which extend downwardly from respective right and left end portions of the main portion 42*a* and which are positioned outside the side walls of the recording head 41; and a pair of guide portions 42*g*, 42*g* which extend downwardly from the main portion 42*a* and which are located inside the respective engagement establishing arms 42*d*, 42*d*.

The entirety of the first body 42 or at least each of the engagement establishing arms 42*d* of the first body 42 is made of an elastic material such as resin or rubber. Each of the arms 42*d*, 42*d* is integrally connected at its proximal end portion 42*j* to the main portion 42*a*, and is elastically deformable or pivotable about the proximal end portion 42*j*, by applying a force thereto, so as to cause a distal end portion 42*f* to be displaceable inwardly and outwardly. That is, a distance between the distal end portions 42*f*, 42*f* of the respective arms 42*d* is variable by the pivot movement of the arms 42*d*, 42*d*. The distance between the distal end portions 42*f*, 42*f* is larger than a distance between upper ends of the respective inclined portions 41*e*, 41*e*, when the arms 42*d*, 42*d* are not deformed or pivoted. The engaging portion 42*e*, which is to be brought into fixed engagement with the corresponding engaged portion 41*f* of the recording head 41, is provided by an inwardly protruding portion located intermediate between the proximal end portion 42*j* and the distal end portion 42*f*. A lower surface of the engaging portion 42*e* is inclined upwardly as it extends inwardly, so that the first body 42 can be smoothly moved relative to the recording head 41 upon contact of the engaging portion 42*e* with the inclined surface 41*e*.

The first body 42 includes a first sealing portion 42*b* that is provided in the main portion 42*a* of the first body 42. When the engaging portions 42*e*, 42*e* of the first body 42 are brought into fixed engagement with the respective engaged portions 41*f*, 41*f* of the recording head 41, the first sealing portion is brought into contact with the upper surface 41*i* of the holder portion 41*m* (the inside surface of the recording head 41) in which the ink inlet 41*c* opens. While the engaging portions

42*e*, 42*e* are held in fixed engagement with the respective engaged portions 41*f*, 41*f*, the guide portions 42*g*, 42*g* are held in contact with recessed portions of the upper surface 41*i* that are located inside the side walls of the recording head 41. Thus, each of the guide portions 42*g*, 42*g* cooperates with a corresponding one of the engaging portions 42*e*, 42*e* to sandwich a part of the holder portion 41*m* therebetween, so as to fix the first body 42 to the recording head 41.

The first sealing portion 42*b* has an annular-shaped recess 42*c* that is to be aligned with the annular-shaped connecting member 41*d* for accommodating therein an upper end portion of the connecting member 41*d*. When the first body 42 is fixed to the recording head 41, the connecting member 41*d* is compressed by the first sealing portion 42*b* and is held in close contact with the first sealing portion 42*b*, whereby the ink inlet 41*c* surrounded by the connecting member 41*d* is reliably sealed by the first sealing portion 42*b* from an exterior.

Figure 6:
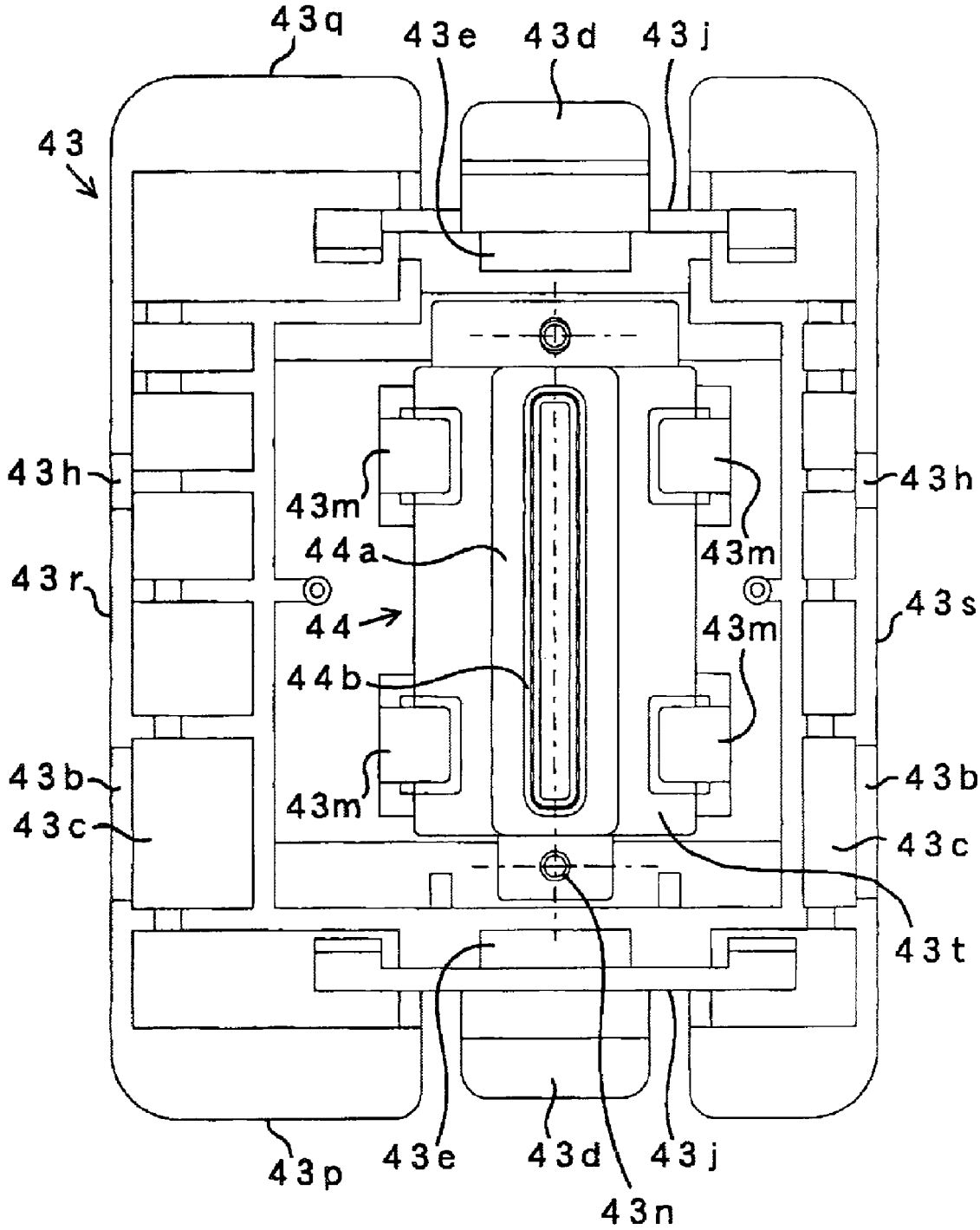
FIG. 6 is an upper plan view of a second body of the recording head storage housing according to the first embodiment of the invention.

As shown in FIGS. 2, 3 and 6, the second body 43 includes a bottom wall 43*t* and front and rear side walls 43*p*, 43*q* in addition to the above-described right and left side walls 43*s*, 43*r*. The above-described nozzle sealing member 44 as the second sealing portion is fixed to the bottom wall 43*t*. The front, rear, right and left side walls 43*p*, 43*q*, 43*s*, 43*r* cooperate with each other to constitute a second extending portion (second wall portion), and extend from a periphery of the bottom wall 43*t*, so that the second body 43 as a whole is provided by a box-like shaped body having an upper opening 43*a*. On an upper surface of the bottom wall 43*t*, there are provided two pairs of retainer portions 43*m*, 43*m* and a pair of positioning pins 43*n*, 43*n* for fixedly positioning the nozzle sealing member 44 as a nozzle protector in a predetermined position. The two pairs of retainer portions 43*m*, 43*m* (each having a inverted-L shape in its cross section as shown in FIG. 2) are held in fixed engagement with right and left end portions of the nozzle sealing member 44, while the pair of positioning pins 43*n* are held in fixed engagement with front and rear end portions of the nozzle sealing member 44.

Rectangular-shaped cutouts 43*w*, 43*w* are formed in the right and left side walls 43*s*, 43*r*, so as to be located in respective positions corresponding to the first body 42. The right and left side walls 43*s*, 43*r* include respective portions which are located below the cutouts 43*w*, 43*w* and which serve as protecting covers 43*b*, 43*b* for covering outer surfaces of the distal end portions 42*f*, 42*f* of the engagement establishing arms 42*d*, 42*d*. A distance between inner surfaces of the covers 43*b*, 43*b* as measured in right and left direction is larger than a distance between the outer surfaces of the distal end portions 42*f*, 42*f* of the engagement establishing arms 42*d*, 42*d*, so that the distal end portions 42*f*, 42*f* of the arms 42*d*, 42*d* of the first body 42 are introducible inside the box-like shaped second body 43.

The inner surfaces of the right and left protecting covers 43*b*, 43*b* include respective portions that are inclined inwardly as they extend downwardly towards the, bottom wall 43*t*. The inclined portions of the inner surfaces of the covers 43*b*, 43*b* serve as pressing portions 43*c*, 43*c* for forcing the engaging portions 42*e*, 42*e* of the arms 42*d*, 42*d* against the engaged portions 41*f*, 41*f* of the recording head 41. That is, the pressing portions 43*c*, 43*c* force the distal end portions 42*f*, 42*f* of the arms 42*d*, 42*d* inwardly, as the first body 42 is introduced into the second body 43. As shown in FIGS. 3 and 6, recesses 43*j*, 43*j* are formed in central portions of the front and rear side walls 43*p*, 43*q* of the second body 43, so as to be recessed inwardly as seen in a plan view of the second body 43.

A bottom of each of the recesses 43*j*, 43*j* is defined by a wall 43*f* (see FIG. 3) whose upper half is adapted to be inwardly and outwardly deformable in an elastic manner. The wall 43*f* defining the bottom of the recess 43*j* of the front side wall 43*p* has an upper end portion from which an engaging portion 43*e* protrudes inwardly, while the wall 43*f* defining the bottom of the recess 43*j* of the rear side wall 43*q* has an upper end portion from which an engaging portion 43*g* protrudes inwardly. Further, engagement releasing portions 43*d*, 43*d* are provided to project outwardly from the upper end portions of the walls 43*f*, and are operable to release the engagement of the engaging portions 43*e*, 43*g* with the recording head 41, by elastically deflecting the walls 43*f*, 43*f*. The engagement releasing portions 43*d*, 43*d* have respective lower ends that are located lower than the deformable upper halves of the walls 43*f*, 43*f*. The engagement releasing portions 43*d*, 43*d* are sized not to project outwardly from the recesses 43*j*, 43*j*. In other words, the engagement releasing portions 43*d*, 43*d* are provided by recessed portions of the front and rear side walls 43*p*, 43*q*.

Figure 8:
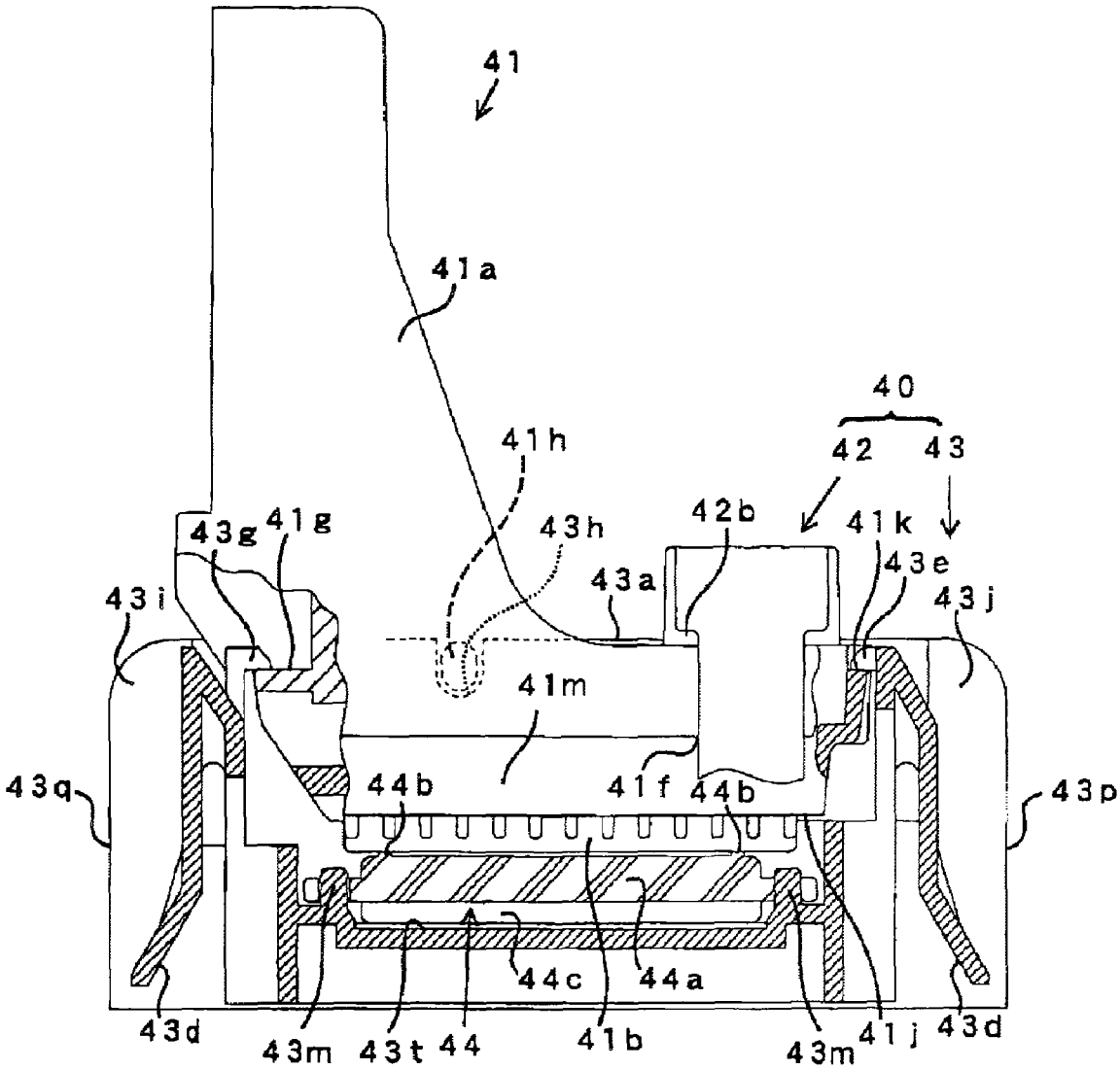
FIG. 8 is a left-side view showing, partially in cross section, the recording head storage housing according to the first embodiment of the invention and the recording head that is being stored by the storage housing.

When the recording head 41 is introduced into the second body 2, the engaging portion 43*e* of the front side wall 43*p* is brought into fixed engagement with an upper surface of an engaged portion 41*k* provided in a front wall of the holder portion 41*m*, and the engaging portion 43*g* of the rear side wall 43*q* is brought into fixed engagement with an upper surface of an engaged portion 41*g* provided in a rear wall of the holder portion 41*m* (see FIG. 8). The engaging portions 43*e*, 43*g* are disengaged from the engaged portions 41*k*, 41*g*, when the upper halves of the walls 43*f*, 43*f* are deflected outwardly by inwardly pressing the engagement releasing portions 43*d*, 43*d*.

The nozzle sealing member 44, which is made of an elastic material such as rubber, includes: a plate-like base portion 44*a* having substantially the same size as the nozzle opening surface 41*b* of the recording head 4; an annular-shaped rib 44*b* projecting upwardly from an upper surface of the base portion 44*a* so as to surround the nozzles opening in the nozzle opening surface 41*b*; and a spacer 44*c* projecting downwardly from a lower surface of the base portion 44*a* so as to position the sealing member 44 in a predetermined height. The base portion 44*a* has recesses formed in right and left end portions of its upper surface, so that the above-described inverted-L shaped retainer portions 43*m* are fixedly engaged at their distal end portions with the recesses, so as to position the sealing member 44.

Figure 7:
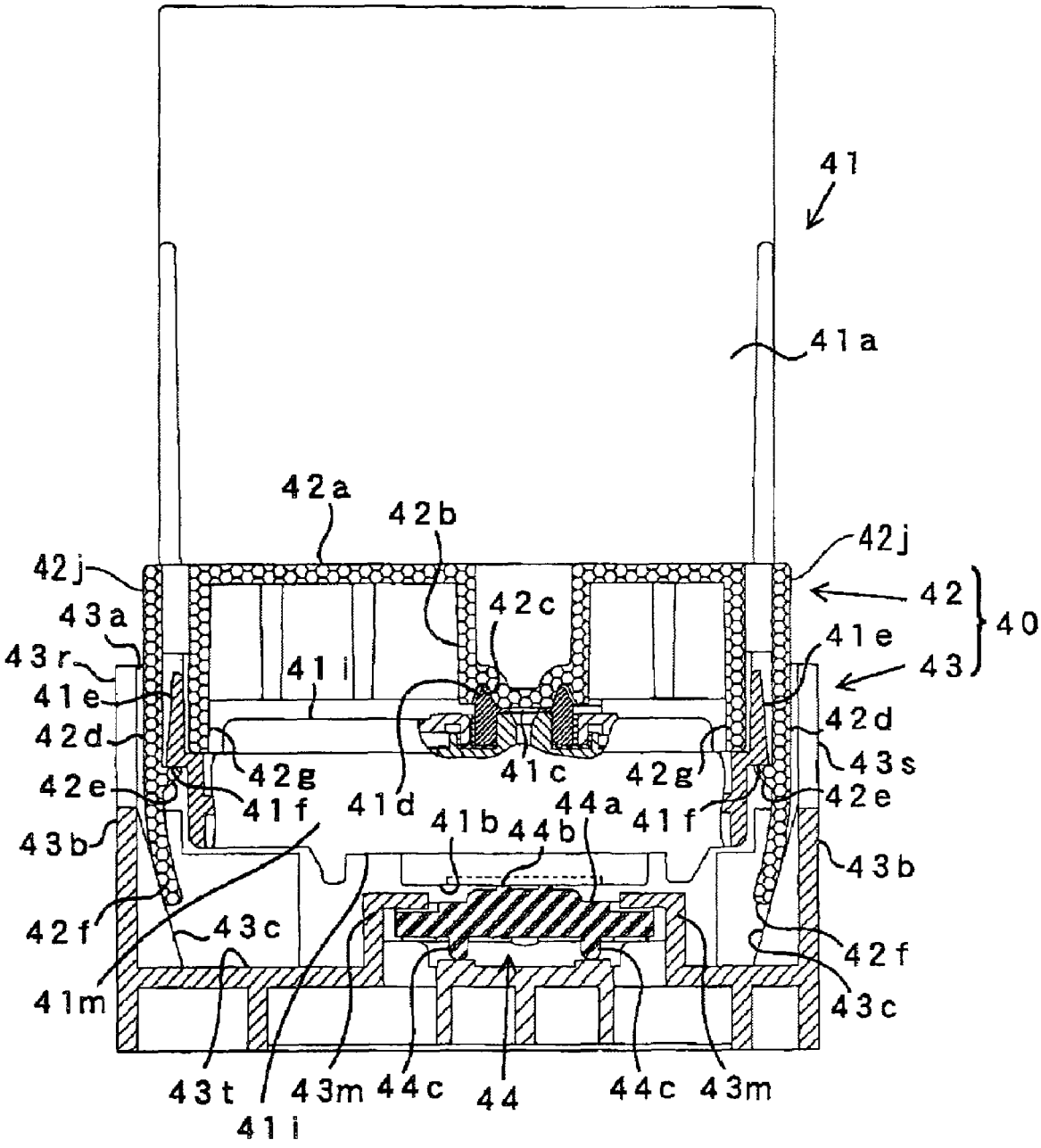
FIG. 7 is a front view showing, in cross section, the recording head storage housing according to the first embodiment of the invention and the recording head that is being stored by the storage housing.

There will be described a process of storing the recording head 41 by using the ink cartridge storage housing 40, with-reference to FIGS. 7 and 8.

Firstly, the first body 42 is positioned relative to the recording head 41 such that the engagement establishing arms 42*d*, 42*d* are substantially aligned with the inclined portions 41*e*, 41*e* of the recording head 41. As the first body 42 thus positioned relative to the recording head 41 is moved downwardly toward the recording head 41, the engaging portions 42*e*, 42*e* of the arms 42*d*, 42*d* are slid on the outer surfaces of the inclined portions 41*e*, 41*e* of the recording head 41. As the engaging portions 42*e*, 42*e* are slid on the outer surfaces of the inclined portions 41*e*, 41*e*, the engaging portions 42*e*, 42*e* are forced outwardly by the inclined portions 41*e*, 41*e*, so that the distal end portions 42*f*, 42*f* of the arms 42*d*, 42*d* are displaced outwardly.

With further movement of the first body 42 relative to the recording head 41 in the downward direction, the engaging portions 42*e*, 42*e* pass over the lower end portions of the inclined portions 41*e*, 41*e*, so as to be brought into engagement with the engaged portions 41*f*, 41*f*, owing to elasticity of the arms 42*d*, 42*d*. With the engaged portions 41*f*, 41*f* being sandwiched by the guide portions 42*g*, 42*g* and the engaging potions 42*e*, 42*e* in the vertical direction (see FIG. 7), the first body 42 is fixed to the recording head 41. In this instance, the annular-shaped connecting member 41*d* is compressed by the first sealing portion 42*b* and is held in close contact with the first sealing portion 42*b*, whereby the ink inlet 41*c* surrounded by the annular-shaped connecting member 41*d* is fluid-tightly sealed by the first sealing portion 42*b*.

Next, the second body 43 is positioned to be opposed to the first body 42 to which the recording head 41 is fixed. Namely, the first and second bodies 42, 43 are positioned to be opposed to each other in an opposed direction corresponding to the vertical direction as seen FIGS. 7 and 8, while the holder portion 41*m* of the recording head 41 is interposed between the first and second bodies 42, 43. The thus positioned first body 42 together with the recording head 41 is introduced inside the box-like shaped second body 43 through the upper opening 43*a*. In this instance, as the distal end portions 42*f*, 42*f* of the arms 42*d*, 42*d* are introduced inside the protecting covers 43*b*, 43*b* of the second body 43, the distal end portions 42*f*, 42*f* are brought into contact with the pressing portions 43*c*, 43*c* of the second body 43. With further movement of the first body 42 relative to the second body 43 in the downward direction, the distal end portions 42*f*, 42*f* are guided inwardly by the pressing portions 43*c*, 43*c* that are provided by the inclined portions of the inner surfaces of the protecting covers 43*b*, 43*b*, so that the engaging portions 42*e*, 42*e* are forced against the engaged portions 41*f*, 41*f*, so as to be firmly engaged with the engaged portions 41*f*, 41*f*.

The first body 42 together with the recording head 41 is further deeply into the box-like shaped second body 43, until the nozzle opening surface 41*b* is brought into contact with the nozzle sealing member 44. For fixing the second body 43 and the recording head 41 to each other, the engaging portions 43*e*, 43*g* of the second body 43 are brought into engagement with the engaged portions 41*k*, 41*g* of the holder portion 41*m*. In this instance, the rib 44*b* of the nozzle sealing member 44 is pressed against the nozzle opening surface 41*b*, while the second body 43 and the recording head 41 are fixed to each other. The rib 44*b* is held in close contact with the nozzle opening surface 41*b*, so that the nozzles are sealed, with the openings of the nozzles being spaced by a predetermined distance from a recessed surface surrounded by the annular-shaped rib 44*b*.

As described above, the ink inlet 41*c* is sealed by the first sealing portion 42*b* of the first body 42 that is fixed to the recording head 41, while the nozzles opening in the nozzle opening surface 41*b* are sealed by the nozzle sealing member 44 as the second sealing portion of the second body 43 that is fixed to the recording head 41. The first body 42 is not detached independently from the recording head 41, since the engaging portions 42*e*, 42*e* are inhibited by the pressing portions 43*c*, 43*c* of the second body 43, from being disengaged from the engaged portions 41*f*, 41*f*.

When the recording head 41 is to be detached from the second body 43, the engaging portions 43*e*, 43*g* are displaced outwardly by inwardly pressing the lower end portions of the engagement releasing portions 43*d*, 43*d*, so that the engaging portions 43*e*, 43*g* are disengaged from the engaged portions 41*k*, 41*g*. When the first body 42 is to be detached from the recording head 41, after the recording head 41 has been detached from the second body 43, the engagement of the engaging portions 42*e*, 42*e* with the engaged portions 41*f*, 41*f* are released by displacing the distal end portions 42*f*, 42*f* of the arms 42*d*, 42*d* outwardly.

In the recording head storage housing 40 of the first embodiment of the invention constructed as described above, the first body 42 including the first sealing portion 42*b* and the second body 43 including the nozzle sealing member 44 as the second sealing portion are opposed to each other in the opposed direction, with the recording head 41 being interposed between the first and second bodies 42, 43 in the opposed direction, such that the ink inlet 41*c* is sealed by the first sealing portion 42*b* and such that the nozzles are sealed by the nozzle sealing member 44. The first body 42 includes the first extending portion providing the engagement establishing arms 42*d*, while the second body 43 includes the second extending portion providing the protecting covers 43*b*. The engagement establishing arms 42*d* and the covers 43*b* extend in the opposed direction and are positioned outside the interposed recording head 41 as seen in the opposed direction (i.e., as seen in a plan view perpendicular to the opposed direction). The engagement establishing arms 42*d*, 42*d* are manually movable to attach and detach the first body 42 to and from the recording head 41. At least the distal end portion 42*f* of each of the arms 42*d*, 42*d* is covered by the corresponding cover 43*b* that is positioned outside the distal end portion 42*f* of the arm 42*d*, whereby at least the distal end portion 42*f* of each arm 42*d* is protected by the cover 43*b* from an external load, thereby eliminating a risk of removal of the first body 42 from the recording head 41. Further, in the present recording head storage housing 40, the recording head 41 can be stored, with the ink inlet 41*c* and the nozzles being sealed, simply by attaching the first and second bodies 42, 43 to the recording head 41. That is, the present storage housing 40 is capable of storing the recording head 41 while reliably sealing the ink inlet 41*c* and the nozzles of the recording head 41.

Further, in the present recording head storage housing 40, the first body 42 is attached to the recording head 41 by the engagement of the engaging portions 42*e* (provided by the protruding portions protruding inwardly as seen in the opposed direction) of the arms 42*d* with the engaged portions 41*f*, 41*f* of the recording head 41, such that the ink inlet 41*c* is sealed by the first sealing portion 42*b* of the first body 42. Therefore, there is no risk that the first body 42 could be detached from the recording head 41 accidentally, for example, by vibration caused during transit. Further, simply bringing the engaging portions 42*e*, 42*e* in engagement with the engaged portions 41*f*, 41*f*, it is possible not only to attach the first body 42 to the recording head 41 but also to cause the ink inlet 41*c* to be sealed by the first sealing portion 42*b*.

Further, the protecting covers 43*b*, 43*b* include the pressing portions 43*c*, 43*c*, which forces or presses the engaging portions 42*e*, 42*e* of the first body 42 against the engaged portions 41*f*, 41*f* of the recording head 41 while the first and second bodies 42, 43 are attached to the recording head 41. Thus, the engaging portions 42*e*, 42*e* pressed against the engaged portions 41*f*, 41*f* are firmly engaged with the engaged portions 41*f*, 41*f*. In this arrangement, since the second body 43 has to be detached from the recording head 41 when disengagement of the engaging portions 42*e*, 42*e* from the engaged portions 41*f*, 41*f* are required, there is no risk that the first body 42 could be individually detached from the recording head 41, so that the ink inlet 41*c* can be further reliably held in its sealed state.

The second body 43 (storage casing) is provided by the box-like shaped body having the bottom wall 43*t* (to which the nozzle sealing member 44 is attached) and the side walls 43*p*, 43*q*, 43*s*, 43*r* which extend in the opposed direction from the periphery of the bottom wall 43*t*. Since the protecting covers 43*b*, 43*b* are provided by portions of the right and left side walls 43*s*, 43*r*; the distal end portions 42*f*, 42*f* of the arms 42*d*, 42*d* of the first body 42 are covered by the covers 43*b*, 43*b* of the second body 43, by simply storing the recording head 41 in the box-like shaped second body 43. In this arrangement, the ink inlet 41*c* can be reliably held in its sealed state, without risk of removal of the first body 42 from the recording head 41.

The front and rear side walls 43*p*, 43*q* are formed with the respective engaging portions 43*e*, 43*g* that are to be engaged with the recording head 41, so that the second body 43 can be attached to the recording head 41 with the nozzles being sealed, by simply bringing the engaging portions 43*e*, 43*g* into engagement with the recording head 41. In this arrangement, by simply storing the recording head 41 in the box-like shaped second body 43, the recording head 41 can be fixed in a predetermined position relative to the second body 43, and the nozzles can be reliably sealed by the nozzle sealing member 44 provided in the second body 43.

Further, the engaging portions 43*e*, 43*g* are connected to the engagement releasing portions 43*d*, 43*d* which are provided by recessed portions of the respective front and rear side walls 43*p*, 43*q* that are recessed inwardly as seen in the opposed direction. Since the engagement releasing portions 43*d*, 43*d* are operable to release the engagement of the engaging portions 43*e*, 43*g* with the recording head 41, the recording head 41 can be easily removed from the second body 43, by simply operating the engagement releasing portions 43*d*, 43*d* to release the engagement. Further, since the engagement releasing portions 43*d*, 43*d* are provided by the recessed portions of the front and rear side walls 43*p*, 43*q*, there is no risk of accidental disengagement of the engaging portions 43*e*, 43*g* with the recording head 41, which could be caused in the event of application of external force to the engagement releasing portions 43*d*, 43*d*, (for example, by an object brought into contact with the engagement releasing portions 43*d*, 43*d*) during transit or storage.

Figure 9:
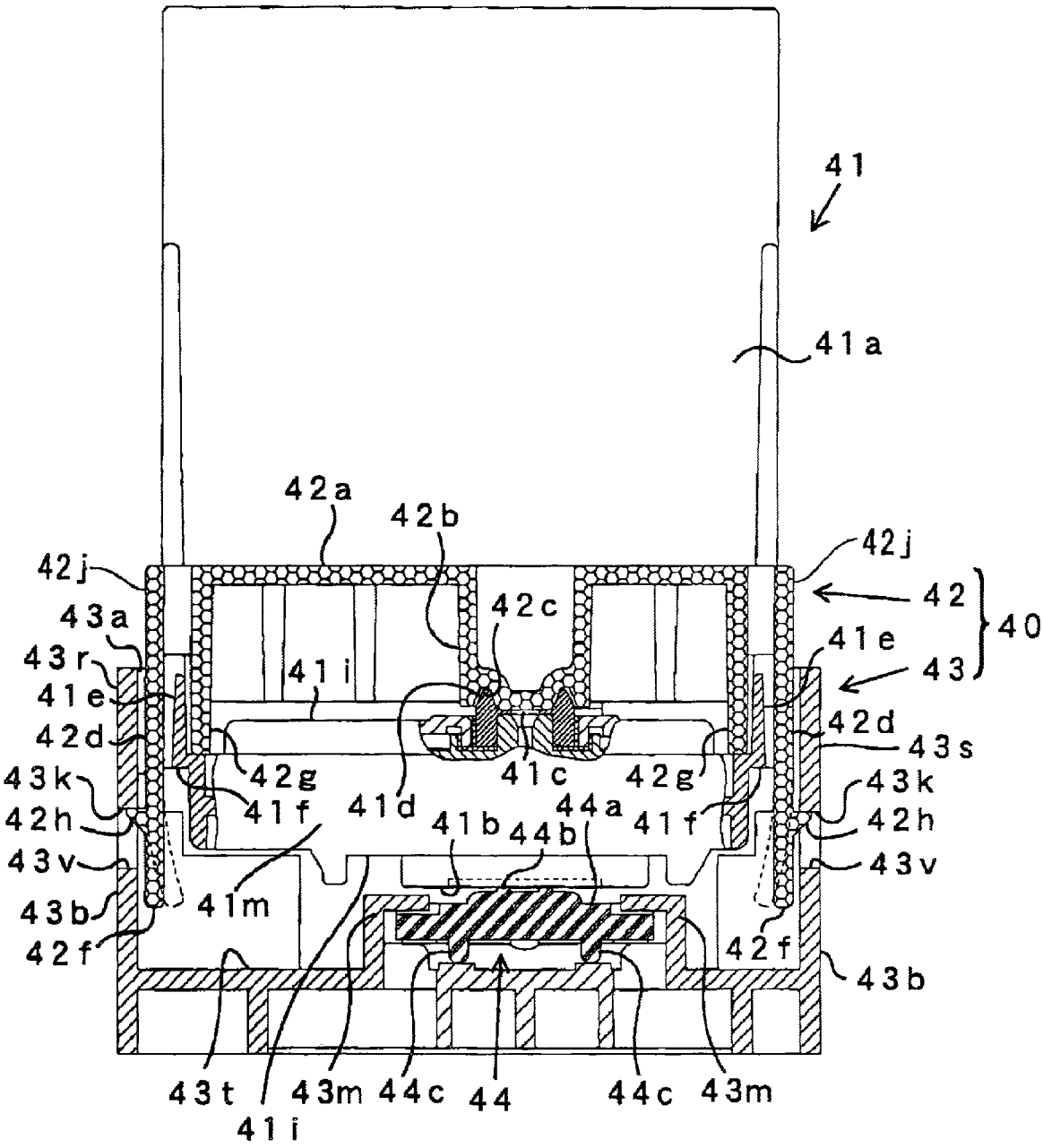
FIG. 9 is a front view showing, in cross section, a recording head storage housing according to a second embodiment of the invention and the recording head that is being stored by the storage housing.
Figure 10:
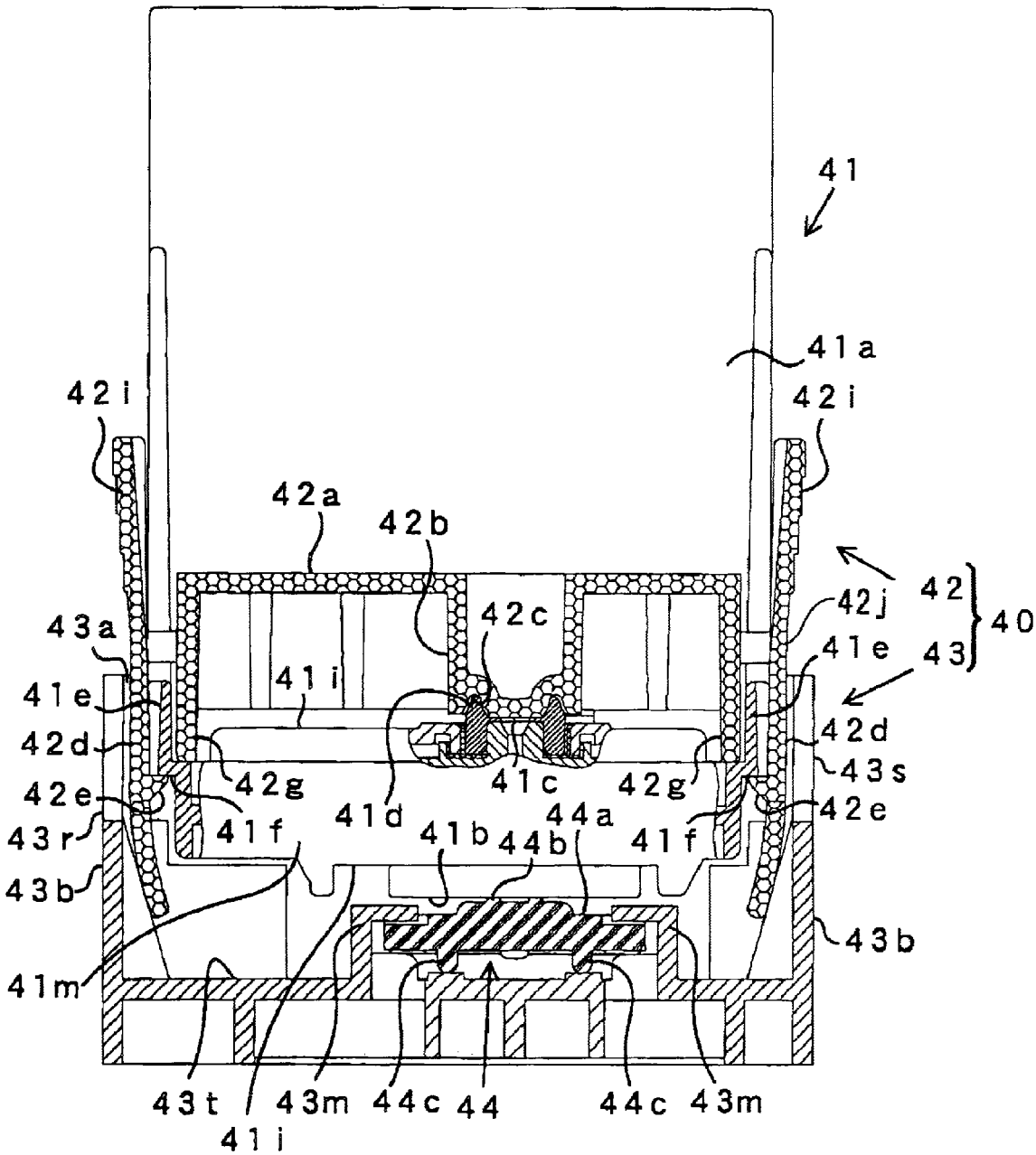
FIG. 10 is a front view showing, in cross section, a recording head storage housing according to a third embodiment of the invention and the recording head that is being stored by the storage housing.

Referring next to FIGS. 9 and 10, there will be next described other embodiments the invention. In the following description, the same reference signs as used in the description of the first embodiment are used to identify the same components or elements, which will not be described to avoid redundancy of the description.

FIG. 9 is a front view showing, in cross section, the recording head storage housing 40 according to a second embodiment of the invention and the recording head 41 that is being stored by the storage housing 40. The first body 42 includes engaging portions 42*h*, 42*h* provided by intermediate portions of the engagement establishing arms 42*d*, 42*d* which protrude outwardly. The protecting covers 43*b*, 43*b* of the second body 43 have respective openings 43*v*, 43*v* that are opposed to the arms 42*d*, 42*d*. The engaging portions 42*h*, 42*h* are arranged to be held in engagement with engaged portions 43*k*, 43*k* provided by portions of the covers 43*b*, 43*b* which define upper ends of the respective openings 43*v*, 43*v*. The first and second bodies 42, 43 are attached to the recording head 41 that is interposed between the first and second bodies 42, 43, by the engagement of the engaging portions 42*h*, 42*h* of the first body 42 with the engaged portions 43*k*, 43*k* of the second body 43. Therefore, in the second embodiment, the recording head 41 can be attached to the second body 43, even in an arrangement without the engaging portions 43*e*, 43*g* and the engagement releasing portions 43*d*, 43*d* of the second body 43 (see FIG. 3) that are provided in the above-described first embodiment.

There will be described a process of storing the recording head 41 by using the ink cartridge storage housing 40 constructed according to the second embodiment of the invention.

Firstly, the first body 42 is mounted on the recording head such that the first sealing portion 42*b* is substantially aligned with the ink inlet 41*c*. Then, the second body 43 is positioned to be opposed to the first body 42 that is mounted on the recording head 41. Namely, the first and second bodies 42, 43 are positioned to be opposed to each other in the opposed direction corresponding to the vertical direction as seen FIG. 9, while the holder portion 41*m* of the recording head 41 is interposed between the first and second bodies 42, 43. The thus positioned first body 42 together with the recording head 41 is introduced inside the box-like shaped second body 43 through the upper opening 43*a*. In this instance, as the main portion 42*a* of the first body 42 is pressed downwardly toward the bottom wall 43 of the second body 43, the arms 42*d*, 42*d* are elastically deformed inwardly as seen in the opposed direction. With further movement of the first body 42 relative to the second body 43 in the downward direction, the engaging portions 42*h*, 42*h* reach the engaged portions 43*k*, 43*k* of the second body 43, so as to be brought into engagement with the engaged portions 43*k*, 43*k*, owing to elasticity of the arms 42*d*, 42*d*.

In this instance, the nozzle sealing member 44 is held in pressing contact with the nozzle opening surface 41*b* while the first sealing portion 42*b* is held in pressing contact with the connecting member 41*d*, so that the nozzles are fluid-tightly sealed by the nozzle sealing member 44 while the ink inlet 41*c* surrounded by the connecting member 41*d* is fluid-tightly sealed by the first sealing portion 42*b*. Further, the engaging portions 42*h*, 42*h* are biased upwardly by reaction force generated by the nozzle sealing member 44 and the connecting member 41*d*, and accordingly the engaged portions 43*k*, 43*k* are pressed by the engaging portions 42*h*, 42*h*, whereby the engagement of the engaging portions 42*h*, 42*h* with the engaged portions 43*k*, 43*k* is reliably maintained.

As described above, by the engagement of the engaging portions 42*h*, 42*h* of the first body 42 with the engaged portions 43*k*, 43*k* of the second body 43, the first and second bodies 42, 43 are connected to each other with the recording head 41 being interposed therebetween, such that the ink inlet 41*c* is sealed by the first sealing portion 42*b* of the first body 42, and such that the nozzles are sealed by the nozzle sealing member 44 as the second sealing portion.

When the recording head 41 is to be detached from the second body 43, each of the engaging portions 42*h*, 42*h* is inwardly deflected by an operator's finger or a stick member that is introduced through the corresponding opening 43*v*, so as to release the engagement of the engaging portion 42*h* with the corresponding engaged portion 43*k*. In this instance, the recording head 41 is detached from the first body 42 as well as from the second body 43, since the first body 42 is not engaged with the recording head 41.

In the recording head storage housing 40 of the second embodiment of the invention constructed as described above, the engagement establishing arms 42*d*, 42*d* include the engaging portions 42*h*, 42*h* that are engaged with the protecting covers 43*b*, 43*b*. By the engagement of the engaging portions 42*h*, 42*h* with the covers 43*b*, 43*b*, the first and second bodies 42, 43 are connected to each other with the recording head 41 being interposed therebetween, such that the ink inlet 41*c* is sealed by the first sealing portion 42*b* of the first body 42, and such that the nozzles are sealed by the nozzle sealing member 44 as the second sealing portion. Thus, by simply bringing the engaging portions 42*h*, 42*h* into engagement with the engaged portions 43*k*, 43*k* of the covers 43*b*, 43*b*, it is possible to reliably seal the nozzles and the ink inlet 41*c*.

FIG. 10 is a front view showing, in cross section, the recording head storage housing 40 according to a third embodiment of the invention and the recording head 41 that is being stored by the storage housing 40. This recording head storage housing 40 of the third embodiment is identical with that of the above-described first embodiment except that the first body 42 further includes engagement releasing arms 42*i*, 42*i* operable to release the engagement of the engaging portions 42*e*, 42*e* with the engaged portions 41*f*, 41*f* of the recording head 41. Each of the engagement releasing arms 42*i*, 42*i* extends from the proximal end portion 42*j* of the corresponding engagement establishing arm 42*d* in the upward direction, i.e., in a direction away from the distal end portion 42*f* of the engagement establishing arm 42*d*. When the recording head 41 is to be taken out of the storage housing 40 so as to be used for a recording operation, the engagement releasing arms 42*i*, 42*i* are manually operable, for example, by operator's fingers, to be displaced inwardly as seen in the opposed direction (in which the first and second bodies 42, 43 are opposed to each other), so as to displace the engaging portions 42*e*, 42*e* of the engagement establishing arms 42*d*, 42*d* outwardly as seen in the opposed direction. Thus, the engagement of the engaging portions 42*e*, 42 with the engaged portions 41*f*, 41*f* can be easily released for detaching the first body 42 from the recording head 41.

While the presently preferred embodiments of the invention have been described above in detail, it is to be understood that the invention is not limited to the details of the illustrated embodiments, but may be otherwise embodied without departing from the sprit of the invention.

For example, the inkjet recording apparatus 1 may be provided by either a recording apparatus using piezoelectric elements or a recording apparatus of bubble jet (registered trademark) type using electro-thermal conversion elements.

The present invention is applicable also to a recording head arranged to perform a recoding operation using a plurality of different color inks. In such a case, the first body 42 may include a plurality of first sealing portions 42*b* for sealing a plurality of ink inlets of the recording head (through which the respective different color inks are to be supplied into the recording head), while the second body 43 may include a plurality of nozzle sealing members 44 (second sealing portions) for sealing respective rows of the nozzles (through which the respective different color inks are to be ejected toward a recording medium).

In the first and third embodiments, each of the engaging portions 42*e*, 42*e* of the first body 42, which is provided by the protruding portion of the corresponding engagement establishing arm 42*d*, may have a shape that is not particularly limited. For example, each engaging portion 42*e* may be provided by a hook-shaped protruding portion or a semi-spherical protruding portion. The shape of each of the engaging portions 42*h*, 42*h* in the second embodiment is not particularly limited, either, and may be hook-shaped or semi-spherical-shaped.

In the first and third embodiments, the inclined portions of the inner surfaces of the protecting covers 43*b*, 43*b*, which serve as the pressing portions 43*c*, 43*c*, are provided by straight surfaces that are inclined inwardly as they extend downwardly. However, each of the inclined portions of the inner surfaces of the covers 43*b*, 43*b* may be provided by an inwardly or outwardly convex or concave surface, as long as a distance between the inclined portions (as measured in the right and left direction) is reduced in the downward direction.

In the above-described embodiments, the engagement establishing arms 42*d*, 42*d* are provided in the first body 42, while the protecting covers 43*b*, 43*b* are provided in the second body 43. However, the engagement establishing arms may be provided in the second body 43, while the covers may be provided in the first body 42. In this modified case, the first body 42 may be provided by a box-like shaped body which is configured to cover or not to interfere the mounting portion 41*a* of the recording head 41, and which includes extending portions providing the protecting covers for covering at least the distal end portions of the engagement establishing arms of the second body 43.

What is claimed is:

1. A storage housing for storing a recording head of a recording apparatus that is dismounted from a main body of the recording apparatus, the recording head having an inside surface and an outside surface and operable to perform a recording operation by an ink which is to be supplied to the recording head through an ink inlet opening in the inside surface and which is to be ejected toward a recording medium through nozzles opening in the outside surface, said storage housing comprising:

a first body and a second body which include a first sealing portion and a second sealing portion, respectively, and which are opposed to each other in an opposed direction, with the inside and outside surfaces of the recording head being interposed between said first and second bodies in said opposed direction, such that the ink inlet opening in the inside surface is sealed by said first sealing portion and such that the nozzles opening in the outside surface are sealed by said second sealing portion, wherein said first and second bodies farther include respective first and second extending portions which extend in said opposed direction and which are positioned outside the interposed recording head as seen in said opposed direction, wherein one of said first and second extending portions provides an arm that is movable to attach and detach one of said first and second bodies that includes said one of said first and second extending portions, to and from the recording head, wherein the other of said first and second extending portions provides a protecting cover that is positioned outside at least a distal end portion of said arm as seen in said opposed direction so as to cover at least said distal end portion of said arms, wherein said arm serves as an engagement establishing arm and includes an engaging portion that is held in engagement with an engaged portion of the recording head interposed between said first and second bodies, wherein said one of said first and second bodies is attached to the recording head by the engagement of said engaging portion with the engaged portion of the recording head such that one of said first and second sealing portions that is included in said one of said first and second bodies is held in contact with a corresponding one of the inside and outside surfaces of the recording head, and wherein said protecting cover includes a pressing portion that presses said arm against the engaged portion of the recording head interposed between said first and second bodies.

2. The storage housing according to claim 1, wherein said arm is integrally connected at a proximal end portion thereof to a main portion of said one of said first and second bodies, said main portion providing a corresponding one of said first and second sealing portions, and wherein said arm is operable to be elastically movable, so as to cause said distal end portion to be displaceable inwardly and outwardly as seen in said opposed direction, whereby said one of said first and second bodies can be attached and detached to and from the interposed recording head.

3. The storage housing according to claim 2, wherein said arm is operable to be elastically pivotable about said proximal end portion, so as to cause said distal end portion to be displaceable inwardly and outwardly as seen in said opposed direction.

4. The storage housing according to claim 1, wherein said engaging portion is provided by a protruding portion of said arm which protrudes inwardly as seen in said opposed direction and which is held in contact with the engaged portion of the interposed recording head.

5. The storage housing according to claim 4, wherein said protruding portion of said arm is positioned relative to the engaged portion of the recording head such that a distance between said protruding portion and the other of said first and second bodies as measured in said opposed direction is smaller than a distance between the engaged portion and said other of said first and second bodies as measured in said opposed direction, so that the contact of said protruding portion with the engaged portion inhibits a displacement of said one of said first and second bodies relative to the recording head in a direction away from said other of said first and second bodies.

6. The storage housing according to claim 1, wherein said one of said first and second extending portions provides, in addition to said engagement establishing arm, an engagement releasing arm that is contiguous to said engagement establishing arm, and wherein said engagement releasing arm is operable to be displaced inwardly as seen in said opposed direction, so as to displace said engaging portion of said engagement establishing arm outwardly as seen in said opposed direction, for thereby releasing the engagement of said engaging portion with the engaged portion of the recording head.

7. The storage housing according to claim 6, wherein said engagement releasing arm extends from a proximal end portion of said engagement establishing arm in a direction away from said distal end portion of said engagement establishing arm.

8. The storage housing according to claim 1, wherein the other of said first and second bodies is provided by a box-like shaped body having (i) a bottom wall which provides one of said first and second sealing portions that is included by said other of said first and second bodies, and (ii) a side wall which extends in said opposed direction from a periphery of said bottom wall and which is provided by said other of said first and second extending portions that provides said protecting cover.

9. The storage housing according to claim 1, wherein said first and second extending portions are positioned, as seen in said opposed direction, outside the recording head that has a mounting portion on which an ink tank is to be mounted.

10. A storage housing for storing a recording head of a recording apparatus that is dismounted from a main body of the recording apparatus, the recording head having an inside surface and an outside surface and operable to perform a recording operation by an ink which is to be supplied to the recording head through an ink inlet opening in the inside surface and which is to be ejected toward a recording medium through nozzles opening in the outside surface, said storage housing comprising:

a first body and a second body which include a first sealing portion and a second sealing portion, respectively, and which are opposed to each other in an opposed direction, with the inside and outside surfaces of the recording head being interposed between said first and second bodies in said opposed direction, such that the ink inlet opening in the inside surface is sealed by said first sealing portion and such that the nozzles opening in the outside surface are sealed by said second sealing portion, wherein said first and second bodies further include respective first and second extending portions which extend in said opposed direction and which are positioned outside the interposed recording head as seen in said opposed direction, wherein one of said first and second extending portions provides an arm that is movable to attach and detach one of said first and second bodies that includes said one of said first and second extending portions, to and from the recording head, wherein the other of said first and second extending portions provides a protecting cover that is positioned outside at least a distal end portion of said arm as seen in said opposed direction so as to cover at least said distal end portion of said arm, wherein said arm serves as an engagement establishing arm and includes a first engaging portion that is held in engagement with an engaged portion of the recording head interposed between said first and second bodies, wherein said one of said first and second bodies is attached to the recording head by the engagement of said first engaging portion with the engaged portion of the recording head such that one of said first and second sealing portions that is included in said one of said first and second bodies is held in contact with a corresponding one of the inside and outside surfaces of the recording head, wherein the other of said first and second bodies is provided by a box-like shaped body having (i) a bottom wall which provides one of said first and second sealing portions that is included by said other of said first and second bodies, and (ii) a side wall which extends in said opposed direction from a periphery of said bottom wall and which is provided by said other of said first and second extending portions that provides said protecting cover, wherein said side wall provides, in addition to said protecting cover, a second engaging portion which is distant from said protecting cover as seen in said opposed direction and which is held in engagement with the recording head interposed between said first and second bodies, and wherein said other of said first and second bodies that includes said side wall is attached to the recording head by the engagement of said second engaging portion with the recording head such that one of said first and second sealing portions that is included in said other of said first and second bodies is held in contact with a corresponding one of the inside and outside surfaces of the recording head.

11. The storage housing according to claim 10, wherein said second engaging portion is connected to an engagement releasing portion which is operable to release the engagement of said second engaging portion with the recording head, and wherein said engagement releasing portion is provided by a recessed portion of said side wall that is recessed inwardly as seen in said opposed direction.

12. The storage housing according to claim 10, wherein said arm is integrally connected at a proximal end portion thereof to a main portion of said one of said first and second bodies, said main portion providing a corresponding one of said first and second sealing portions, and wherein said arm is operable to be elastically movable, so as to cause said distal end portion to be displaceable inwardly and outwardly as seen in said opposed direction, whereby said one of said first and second bodies can be attached and detached to and from the interposed recording head.

13. The storage housing according to claim 12, wherein said arm is operable to be elastically pivotable about said proximal end portion, so as to cause said distal end portion to be displaceable inwardly and outwardly as seen in said opposed direction.

14. The storage housing according to claim 10, wherein said first engaging portion is provided by a protruding portion of said arm which protrudes inwardly as seen in said opposed direction and which is held in contact with the engaged portion of the interposed recording head.

15. The storage housing according to claim 14, wherein said protruding portion of said arm is positioned relative to the engaged portion of the recording head such that a distance between said protruding portion and the other of said first and second bodies as measured in said opposed direction is smaller than a distance between the engaged portion and said other of said first and second bodies as measured in said opposed direction, so that the contact of said protruding portion with the engaged portion inhibits a displacement of said one of said first and second bodies relative to the recording head in a direction away from said other of said first and second bodies.

16. The storage housing according to claim 10, wherein said protecting cover includes a pressing portion that presses said first engaging portion against the engaged portion of the recording head interposed between said first and second bodies.

17. The storage housing according to claim 10, wherein said one of said first and second extending portions provides, in addition to said engagement establishing arm, an engagement releasing arm that is contiguous to said engagement establishing arm, and wherein said engagement releasing arm is operable to be displaced inwardly as seen in said opposed direction, so as to displace said first engaging portion of said engagement establishing arm outwardly as seen in said opposed direction, for thereby releasing the engagement of said first engaging portion with the engaged portion of the recording head.

18. The storage housing according to claim 17, wherein said engagement releasing arm extends from a proximal end portion of said engagement establishing arm in a direction away from said distal end portion of said engagement establishing arm.

19. The storage housing according to claim 10, wherein said first and second extending portions are positioned, as seen in said opposed direction, outside the recording head that has a mounting portion on which an ink tank is to be mounted.

20. The storage housing according to claim 10, wherein said one of said first and second extending portions provides, in addition to said engagement establishing arm, an engagement releasing arm that is contiguous to said engagement establishing arm, wherein said engagement releasing arm is operable to be displaced inwardly as seen in said opposed direction, so as to displace said first engaging portion of said engagement establishing arm outwardly as seen in said opposed direction, for thereby releasing the engagement of said first engaging portion with the engaged portion of the recording head, wherein said second engaging portion is connected to an engagement releasing arm which is operable to release the engagement of said second engaging portion with the recording head, wherein said engagement releasing portion is provided by a recessed portion of said side wall that is recessed inwardly as seen in said opposed direction, and wherein said engagement releasing arm is located in a position opposed to a first portion of a circumferential surface of the recording head, while said engagement releasing portion is located in a position opposed to a second portion of the circumferential surface of the recording head which is different from the first portion of the circumferential surface of the recording head.

21. A storage housing for storing a recording head of a recording apparatus that is dismounted from a main body of the recording apparatus, the recording head having an inside surface and an outside surface and operable to perform a recording operation by an ink which is to be supplied to the recording head through an ink inlet opening in the inside surface and which is to be ejected toward a recording medium through nozzles opening in the outside surface, said storage housing comprising:

a first body and a second body which include a first sealing portion and a second sealing portion, respectively, and which are opposed to each other in an opposed direction, with the inside and outside surfaces of the recording head being interposed between said first and second bodies in said opposed direction, such that the ink inlet opening in the inside surface is sealed by said first sealing portion and such that the nozzles opening in the outside surface are sealed by said second sealing portion, wherein said first and second bodies further include respective first and second extending portions which extend in said opposed direction and which are positioned outside the interposed recording head as seen in said opposed direction, wherein one of said first and second extending portions provides an arm that is movable to attach and detach one of said first and second bodies that includes said one of said first and second extending portions, to and from the recording head, wherein the other of said first and second extending portions provides a protecting cover that is positioned outside at least a distal end portion of said arm as seen in said opposed direction so as to cover at least said distal end portion of said arm, wherein said arm provided by said one of said first and second extending portions includes an engaging portion that is held in engagement with said protecting cover provided by said other of said first and second extending portions, and wherein said first and second bodies that include said one and other of said first and second extending portions are attached to the recording head by the engagement of said engaging portion with said protecting cover such that said first and second sealing portions that are included in said one and other of said first and second bodies are held in contact with the inside and outside surfaces of the recording head, respectively.

22. The storage housing according to claim 21, wherein said arm is integrally connected at a proximal end portion thereof to a main portion of said one of said first and second bodies, said main portion providing a corresponding one of said first and second sealing portions, and wherein said arm is operable to be elastically movable, so as to cause said distal end portion to be displaceable inwardly and outwardly as seen in said opposed direction, whereby said one of said first and second bodies can be attached and detached to and from the interposed recording head.

23. The storage housing according to claim 22, wherein said arm is operable to be elastically pivotable about said proximal end portion, so as to cause said distal end portion to be displaceable inwardly and outwardly as seen in said opposed direction.

24. The storage housing according to claim 21, wherein the other of said first and second bodies is provided by a box-like shaped body having (i) a bottom wall which provides one of said first and second sealing portions that is included by said other of said first and second bodies, and (ii) a side wall which extends in said opposed direction from a periphery of said bottom wall and which is provided by said other of said first and second extending portions that provides said protecting cover.

25. The storage housing according to claim 21, wherein said first and second extending portions are positioned, as seen in said opposed direction, outside the recording head that has a mounting portion on which an ink tank is to be mounted.

* * * * *